US010789866B2

(12) United States Patent
Bertlwieser

(10) Patent No.: US 10,789,866 B2
(45) Date of Patent: Sep. 29, 2020

(54) PROFILE ELEMENT COMPRISING LIGHTING MEANS ACCOMMODATED THEREIN

(71) Applicant: FAME Technologies GmbH, Linz (AT)

(72) Inventor: Mario Bertlwieser, St. Stefan am Walde (AT)

(73) Assignee: Fame Technologies GmbH, Linz (AT)

( * ) Notice: Subject to any disclaimer, the term of this patent is extended or adjusted under 35 U.S.C. 154(b) by 310 days.

(21) Appl. No.: 15/500,408

(22) PCT Filed: Jul. 27, 2015

(86) PCT No.: PCT/AT2015/050179
§ 371 (c)(1),
(2) Date: Jan. 30, 2017

(87) PCT Pub. No.: WO2016/015074
PCT Pub. Date: Feb. 4, 2016

(65) Prior Publication Data

US 2017/0221396 A1 Aug. 3, 2017

(30) Foreign Application Priority Data

Jul. 28, 2014 (AT) ..... A 50530/2014

(51) Int. Cl.
*G09F 21/10* (2006.01)
*G09F 9/33* (2006.01)
(Continued)

(52) U.S. Cl.
CPC ..... *G09F 21/10* (2013.01); *F21V 19/0015* (2013.01); *F21V 19/0045* (2013.01);
(Continued)

(58) Field of Classification Search
CPC ..... G09F 21/10; G09F 9/33; G09F 9/3023; F21V 23/004; F21V 21/005;
(Continued)

(56) References Cited

U.S. PATENT DOCUMENTS 4,236,333 A 12/1980 Kohm et al.
4,276,705 A * 7/1981 Barth ..... G09F 13/06 40/547

(Continued)

FOREIGN PATENT DOCUMENTS

DE 202005018149 U1 3/2006
DE 202006013704 U1 2/2008

OTHER PUBLICATIONS

English Language Translation Muecke DE202006013704 Feb. 2008 (Year: 2008).*

(Continued)

*Primary Examiner* — Isiaka O Akanbi
*Assistant Examiner* — Glenn D Zimmerman
(74) *Attorney, Agent, or Firm* — Dickinson Wright PLLC

(57) ABSTRACT

An illumination or display element includes a hollow profile (1) which has a recess extending in a longitudinal direction for receiving a plurality of lighting means (2) and the electric lines thereof. The hollow profile includes two parallel, spaced apart limbs connected by a base body, and the recess is located between the limbs. The recess of the hollow profile is closed by a foil extending at least over a part of an outer lateral surface of the limbs. The foil may completely surround the hollow profile. The lighting means may face the base body of the hollow profile, provided that at least the base body of the hollow profile is transparent or translucent.

20 Claims, 5 Drawing Sheets

(51) Int. Cl.
*G09F 9/302* (2006.01)
*F21V 19/00* (2006.01)
*F21V 21/005* (2006.01)

(52) U.S. Cl.
CPC ..... *F21V 21/005* (2013.01); *G09F 9/3023* (2013.01); *G09F 9/33* (2013.01)

(58) Field of Classification Search
CPC ..... F21V 19/0045; F21V 19/0015; F21W 2107/30; F21S 4/28; F21Y 2115/10; F21Y 2103/10; F21Y 2101/00
See application file for complete search history.

(56) References Cited

U.S. PATENT DOCUMENTS 5,398,170 A * 3/1995 Lee ..... G02B 6/0008 362/224
5,927,845 A * 7/1999 Gustafson ..... B64F 1/002 362/152
6,361,186 B1 3/2002 Slayden
7,273,297 B2 * 9/2007 Cranor ..... A63H 3/36 362/228
7,352,339 B2 * 4/2008 Morgan ..... F24C 7/004 340/815.68
9,518,706 B2 * 12/2016 Chan ..... F21V 15/013
10,352,540 B2 * 7/2019 Jiang ..... F21V 7/005
2002/0126064 A1 9/2002 Yen
2005/0007778 A1 1/2005 Lin
2007/0097015 A1 5/2007 Ronkholz et al.
2007/0263385 A1 * 11/2007 Fan ..... G09F 13/22 362/249.16
2008/0007948 A1 * 1/2008 Fenyo ..... A61N 5/0616 362/235
2009/0323334 A1 12/2009 Roberts et al.
2010/0277914 A1 * 11/2010 Bachl ..... F21V 29/004 362/249.01
2011/0175536 A1 * 7/2011 Fujita ..... H05B 45/40 315/185 R
2013/0238409 A1 * 9/2013 Chatterjee ..... G06Q 30/02 705/14.4
2014/0268736 A1 * 9/2014 Ratkus ..... F21V 17/107 362/235
2015/0360606 A1 * 12/2015 Thompson ..... B60Q 3/54 362/490
2016/0236613 A1 * 8/2016 Trier ..... B60R 13/04

OTHER PUBLICATIONS

Machine English Translation of DE202005018149U1; No named inventor (Year: 2006).*
International Search Report for PCT/AT2015/050179, dated Nov. 11, 2015.

* cited by examiner

PROFILE ELEMENT COMPRISING LIGHTING MEANS ACCOMMODATED THEREIN

This application is a 371 national phase of International Application No. PCT/AT2015/050179, filed Jul. 27, 2015, and is hereby incorpoated by reference in its entirety. The invention relates to a profile element with lighting means accommodated therein, for the formation of a robust illumination or display element, in particular for use as part of a large-area display device.

A display device with a light-emitting diode (LED) display is known from DE 202006013704 U1 for providing a plurality of square and full-area modules on a rack frame next to one another, which support a plurality of LED lighting means. The rack frame supporting the lighting means can also be used to guide the electrical supply lead to the LED lighting means. Although such display devices can offer a small design depth and permit simple assembly, such display devices are structurally comparatively complicated or difficult to design so that they can withstand loads caused by wind, whereby a very robust foundation is also required.

US 2007/0097015 A1 shows a facade display, which consists of many parallel profile elements. Each elongated profile element has a recess extending in the longitudinal direction of the profile element, wherein a plurality of light-emitting diode groups are mounted on a plurality of circuit boards, wherein the plurality of circuit boards each are integrated in a protective mass and the plurality of circuit boards are inserted into the recess, that the light-emitting diode groups at least partially project out of the recesses or are facing at least the outer side or the opening of the respective profile element. It is disadvantageous that the recess of the profile element is completely filled by the protective mass. It is also disadvantageous that the profile element must at least be dimensioned so strongly that the two limbs delimiting the recess are not pressed apart, which can have a drop-out of the protective mass together with the circuit boards when this is held in the recess only by press fitting or clamping. If the protective mass does not completely fill the recess, there is the problem that the recess must be sealed in order to prevent the penetration of dirt and larger amounts of water. Such a partial filling of the recess and solutions to the associated problems are not shown in US 2007/0097015 A1.

DE 202005018149 U1 shows a further development of US 2007/0097015 A1 in which the device comprises an additional transparent profile element which serves as a cover for the profile element. The recess of the supporting profile element is thereby closed by the transparent profile element of the cover; the LEDs are located in the cavity thus formed between the two profile elements. Some disadvantages among others are the more complex design and the additional weight increase by the profile element of the cover.

US2002126064 (A1) shows the structure of a video wall with LED tubes. Printed circuit boards are fastened to it with LEDs in transparent tubes. The circuit boards and LEDs are thus enclosed on all sides by the tube. Some disadvantages among others are the weight of the closed tube, the impeded accessibility, or mounting of the circuit boards in the tube and thus the limited length of a continuous tube section.

In summary, according to the state of the art, three variants are known for producing elongated LED illumination bodies. The first is the use of tubes in which the circuit boards are introduced with the LEDs. In the second and third variants, a profile element open on one side is used, in whose recess the circuit boards are attached, wherein the circuit boards and LEDs are protected against environmental influences either by a castable protective mass or by a rigid transparent cover element.

All previously known variants have the common disadvantage that the resulting illumination bodies or display elements are relatively heavy, or lighter LED elements would be desirable for special use. Furthermore, there is no satisfactory solution according to the prior art in order to protect passers-by from falling parts in the event of mechanical damage to an element.

The object of the invention consists in configuring illuminating or display elements with a plurality of individual lighting means, in particular LEDs, not only compactly but also structurally simple and with a lower dead weight. The display device should thereby have at least a comparable stability with respect to its lighting means.

A further partial object of the invention can be seen in making the illumination or display elements more secure in that, in the event of mechanical damage, no fragments of the illumination or display elements can fall and thereby injure passers-by.

The invention solves the stated problem by arranging an at least partially housed row of lighting means as well as electrical supply leads in the recess of an open hollow profile, wherein the recess of the hollow profile is closed by a foil.

A foil can thereby close the recess over the entire length of the hollow profile or be formed from a plurality of foil segments which overlap in the longitudinal direction of the recess.

The lighting means are preferably LEDs, in particular high-power LEDs, since these are more energy-efficient, more quickly switchable and smaller versus other known lighting means, such as, for example, light bulbs. Each LED is preferably embedded in its own transparent plastic or glass housing, wherein this housing preferably has a region with an increased cross-section at the lower end.

Preferably, the LED lighting means protrudes and, through holes in the foil, partially from the recess of the hollow profile. The foil is preferably matte black. The foil is preferably designed self-adhesive. Preferably, the foil encloses the entire surface of the hollow profile. More preferably, the foil overlaps itself in a partial region.

Preferably, the electrical supply leads run as conductor tracks on a circuit board. The circuit boards are preferably provided with a bus system and driver stages which are used to control the LEDs. Particularly preferably, the circuit board consists of a plurality of segments, which are connected to each other by flexible electrical lines, in particular by flat ribbon cables.

The hollow profile preferably has a U-shaped cross-section. The hollow profile can consist of any material, but preferably of a plastic material, in particular PEEK (polyether ether ketone), or metal material, in particular of aluminum.

Preferably, the hollow profile is elastically deformable so that the two limbs of the profile spaced apart in parallel can be pressed apart during assembly or disassembly under application of force, so long as the foil is not attached.

The LEDs are particularly preferably integrated into a support strip, wherein this support strip is used as a space holder between the limbs of the hollow profile. The support strip also provides lateral stability to the illumination or display element.

The support strip, like the circuit board, can consist of a plurality of segments in order to compensate for changes in length due to thermal expansion. The two limbs of the hollow profile preferably each have a groove in the longitudinal direction which is used to receive the support strip, or a widened housing section of the lighting means. The base body of the hollow profile connecting the two limbs preferably has a groove running in the longitudinal direction, which is used for guiding or supporting the circuit board. The invention can be used as an illumination element. In the simplest case, it is thereby sufficient if all lighting means have the same light color and are formed in parallel.

The invention is particularly preferably implemented as a display element wherein each lighting means can be controlled individually. Lighting means in the colors red, green, blue are thereby preferably arranged in closer proximity to one another in order to form a color pixel. If only one display element according to the invention is present, various optical effects can be realized.

Particularly preferably, a plurality of display elements according to the invention are provided next to one another at a distance on a support frame in order to form a display surface which is configured to be significantly more weight-saving than the prior art. The spaced-apart hollow profiles provide a reduced wind-exposed area versus full-area display panels in which a flow through of the display device in possible so that increased wind loads can be adequately maintained even in the case of a support frame with reduced stiffness values. The creation of a comparatively light yet extremely resilient and stable display device can thus be made possible. In addition, the provision of the LED lighting means in a hollow profile can at the same time also provide for their uniform cooling due to the thermal construction composite. In this way, for example, an improved operating behavior of the light-emitting diodes can be employed, which can be advantageous in the case of high-power LED lighting means, as these are generally used for advertising or displays in order to cut their comparatively high power loss for the purpose of increasing the service life. Since additional cooling, for example, is not necessary by means of fans, the energy requirement of the display device can thus be reduced.

Constructive simplicity also results from the fact that the hollow profiles also lead at least partially to the electrical supply lines of their respective.

LED lighting means, whereby these supply leads can be protected against possible damage. Moreover, in this way, the space between the hollow profiles can be kept free of flow resistors which can reduce the wind-exposed area and thus the mechanical load on the display device.

In order to make the construction composite between LED lighting means and hollow profile particularly load-bearing, it can be provided that the U-shaped hollow profiles each form at least one stop for the housing base of the LED lighting means. Mechanical loads on the LED lighting means can thus be absorbed by the hollow profile and kept away from their electrical supply leads or their control. In the case of vibrations, as might occur due to wind forces when the display device is installed outdoors, there is thus no need to fear a line break—even in adverse operating conditions, a comparatively high stability of the display device can be ensured.

If the housing coverings of the LED lighting means are partly provided for the concerned hollow profile, an impairment of their radiation angles can be avoided and thus a comparatively bright display can be made possible. In addition, the hollow profile can thus provide improved heat dissipation from the housing of the LED lighting means.

Preferably, three successive lighting means each form a color pixel in the hollow profile. Alternatively, each LED lighting means of a hollow profile can form a colored pixel with LED lighting means of another adjacent hollow profile. The division of the three LED lighting means for one color pixel could be made on two or three adjacent hollow profiles.

If the controller has at least one receiving unit for receiving display data and at least two driver stages electrically connected to the receiving unit, which are each electrically connected to the LED lighting means of a hollow profile and are provided in this hollow profile, the cabling effort for the individual LED lighting means can be reduced.

If the receiving unit is connected to the driver stages of the respective hollow profile via its own electrical data line, one connection to each hollow profile can be sufficient to individually control its LED lighting means. In addition, the hollow profiles can be exchanged comparatively easily, so that maintenance effort in the event of defective LED lighting means can be significantly reduced.

The invention is illustrated by means of drawings wherein these represent exemplary, particularly preferred embodiments of the invention:

FIG. 1: FIGS. 1*a* and 1*b* show in cross-section particularly preferred illumination or display elements in which the individual lighting means protrude from the profile element.

FIG. 2: FIGS. 2*a* and 2*b* show in cross-section particularly preferred illumination or display elements in which the individual lighting means do not protrude from the profile element.

Figure 5A:
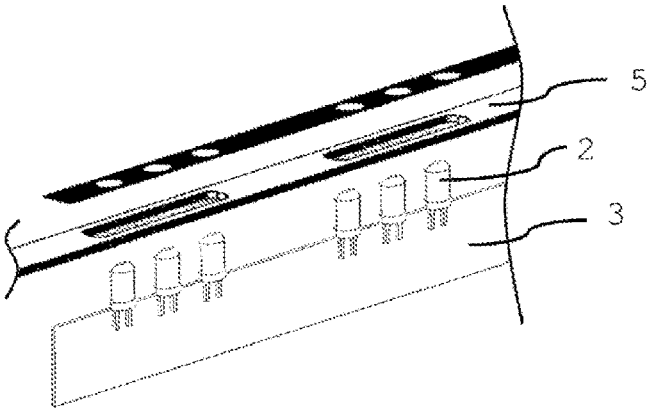
Figure 5B:
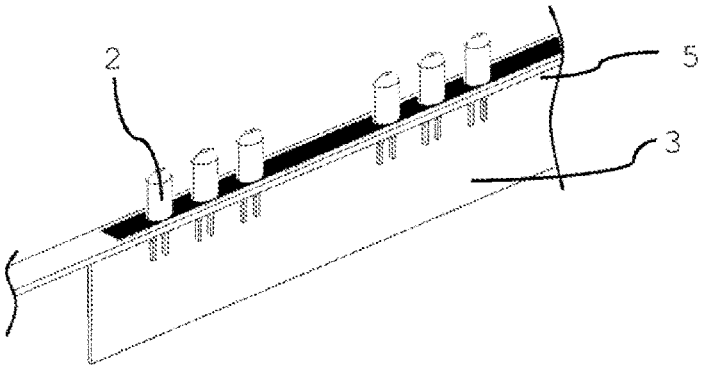
Figure 5C:
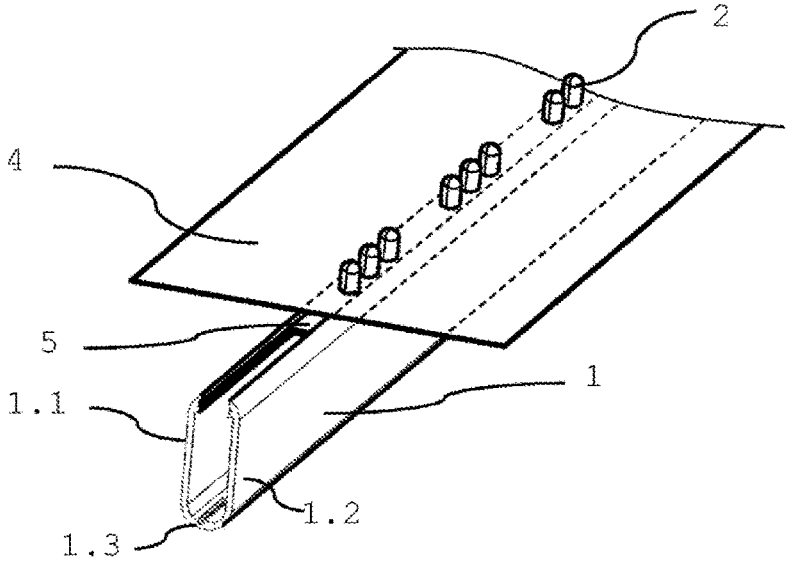

FIG. 5: FIGS. 5*a*, 5*b* and 5*c* schematically show the assembly of a particularly preferred illumination or display element.

Figure 6:
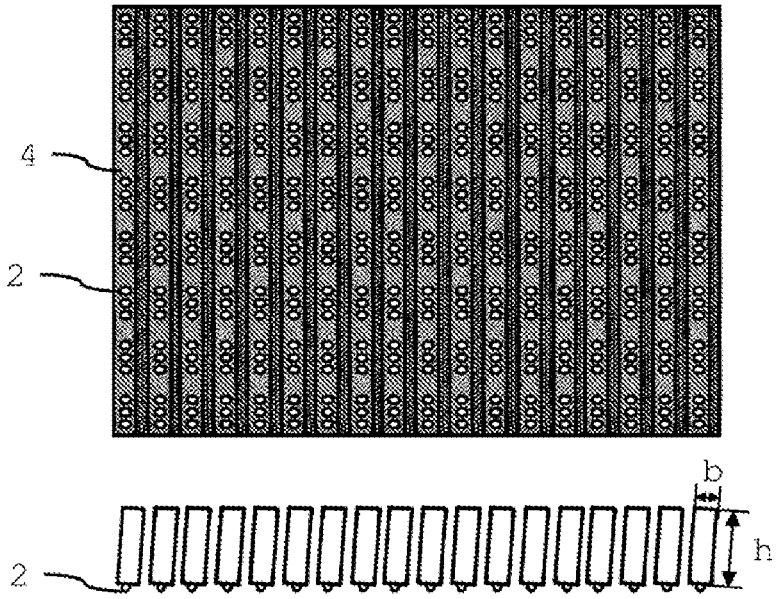

FIG. 6: Shows a display surface composed of display elements according to the invention from the front and from above.

Figure 7:
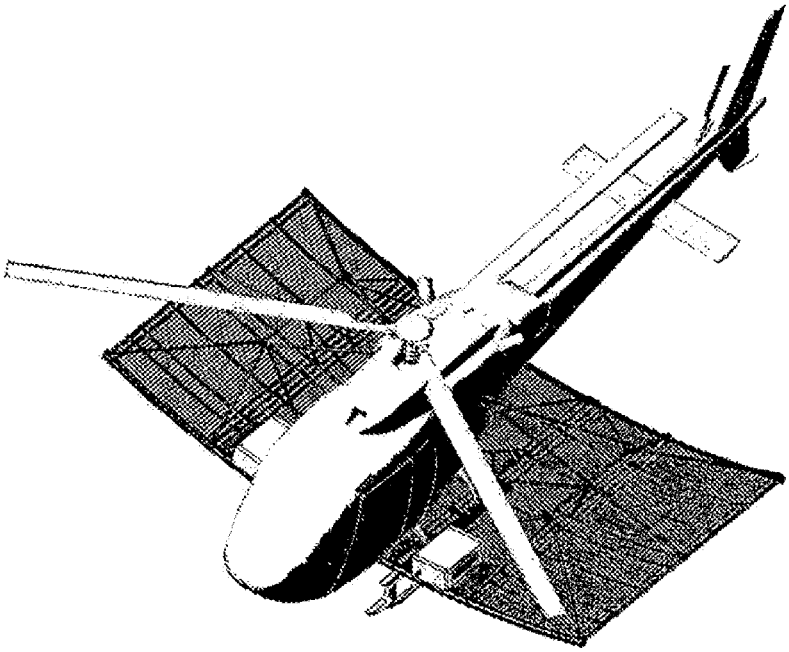

FIG. 7: Shows the particularly advantageous use of display elements according to the invention on a helicopter.

Figure 8A:
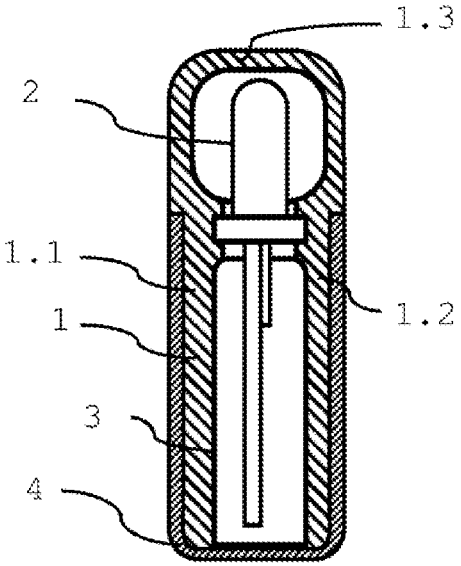
Figure 8B:
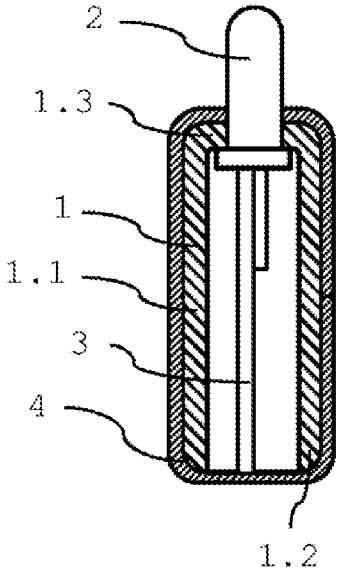

FIG. 8: FIGS. 8*a* and 8*b* show in cross-section illumination or display elements according to the invention in which the lighting means point in the direction of the base body of the hollow profile.

Figure 1A:
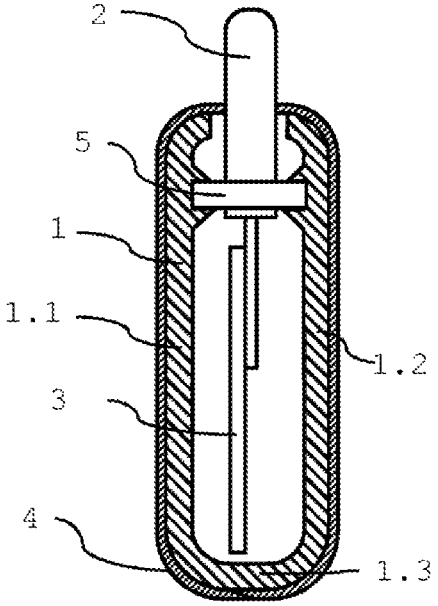

FIG. 1*a* shows a particularly preferred exemplary illuminating or display element. This consists of a hollow profile 1 which has a recess in the longitudinal direction. At least one circuit board 3 is located in this recess, on which a plurality of lighting means 2, preferably in the form of LEDs, in particular ultra-bright LEDs, are attached. Particularly preferably, the LEDs are attached along a row on the end side of the circuit board, since particularly narrow illumination or display elements result in this way. The LEDs are particularly preferably fastened in at least one support strip 5. The LEDs can, for example, be fixed or press-fit or glued in the support strip 5 in a form-fitting manner and thus secured in particular against movement out of the recess of the hollow profile (upward in FIG. 1*a*). The lighting means 2 protrude from the recess of the hollow profile 1. The two limbs 1.1 and 1.2 of the hollow profile 1 each have a groove for receiving the support strip 5. The unit made of the circuit board 3, lighting means 2 and support strip 5 can be inserted into the hollow profile 1 from the side.

Particularly preferably, the limbs 1.1 and 1.2 can be pressed apart by the application of a force, wherein this itself or the base body 1.3 of the hollow profile 1 connecting the limbs 1.1, 1.2 is bent. After the limbs 1.1, 1.2 have been pushed apart, the unit consisting of the circuit board 3, lighting means 2 and support strip 5 can be inserted into the recess from the front, i.e., at an angle of 90° to the longitudinal extension of the hollow profile 1. If the limbs 1.1, 1.2 are returned to the initial position, the support strip 5 is secured in the two grooves of the limbs 1.1, 1.2 against movement in the transverse direction of the hollow profile 1.

The hollow profile 1 is enclosed by a foil 4, wherein the foil 4 is preferably elastic. The foil 4 fulfills several tasks. This serves to press the two limbs 1.1, 1.2 together by tensile stress and thus against the support strip 5. As soon as the foil 4 has been attached, the limbs 1.1, 1.2 are fixed in their position, and the unit consisting of circuit board 3, lighting means 2 and support strip 5 can not be moved or fall out of the recess of the hollow profile 1 even when a force occurs.

The foil 4 is provided with holes through which the lighting means 2 protrude. These holes preferably have a somewhat smaller diameter than the housing of the lighting means 2, whereby the foil 4 surrounds the lighting means 2 as a seal so that no dirt or large amounts of liquid can penetrate into the hollow profile 1.

The foil 4 is particularly preferably so flexible or elastic that the sealing effect at the holes of the foil 4 remains upright when the lighting means 2 are longitudinally displaced due to a different thermal expansion of the hollow profile 1, the circuit board 3 and/or the support strip 5.

The surface of the foil 4 is particularly preferably configured matte black. As a result, the reflection of light on the illumination or display element is minimized, which results in a better contrast. The foil 4 can in principle also be configured as a laminate in all possible colors as well as with visually appealing imprinting, so that the foil 4 can, for example, imitate a wood surface.

The foil 4 particularly preferably surrounds the hollow profile 1 entirely, by which the fragments are held together by the foil 4 in the event of a break in the hollow profile 1 so that they can not fall. Through this, the foil 4 presses the two limbs 1.1, 1.2 against one another and thus prevents an opening of these, the hollow profile 1 can be configured particularly thin-walled and thus lightweight.

Figure 1B:
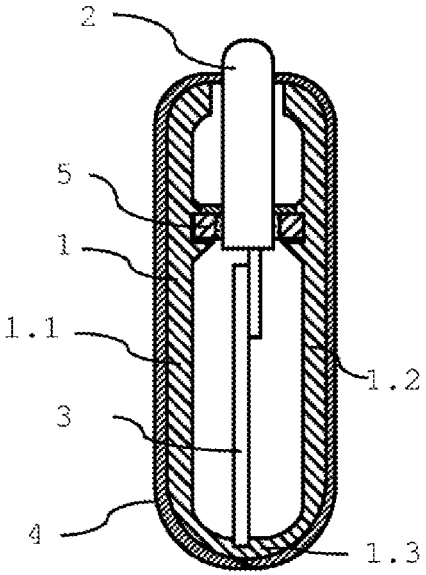

Additional details are shown in FIG. 1*b*, the circuit board 3 can be guided in a groove in the base body 1.3, so that when the hollow profile 1 is aligned horizontally, the circuit board 3 rests on its rear face surface on the side surface of the groove so that the contacts of the light means 2 are less stressed when bent. In addition, the structure of the support strip 4 is shown in several elements, which is set out in greater detail in the description of FIGS. 5*a*-5*c*.

Figure 2A:
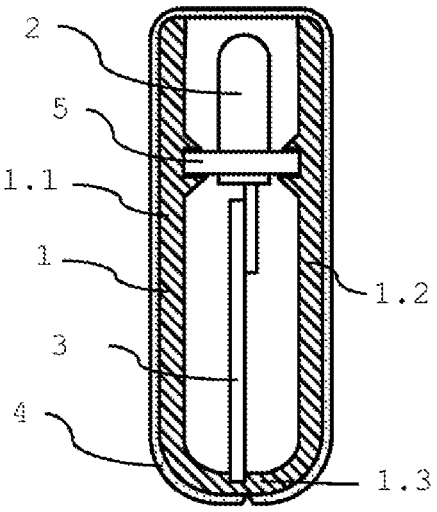
Figure 2B:
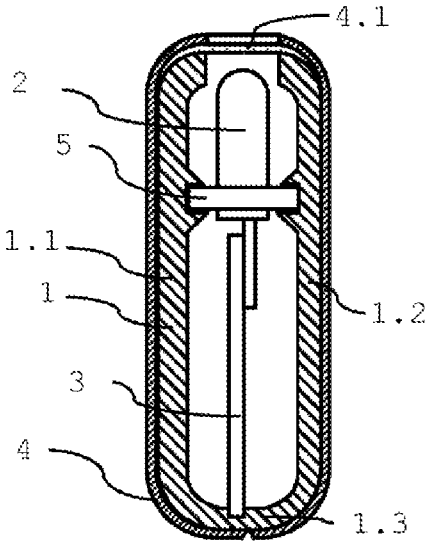

FIGS. 2*a* and 2*b* show illumination or display elements according to the invention, in which the lighting means do not protrude from the hollow profile 1. In this case, the foil 4 has no holes. The simpler construction is advantageous, the limited radiation angle of the lighting means is disadvantageous, which, however, may also be desired for some applications. As shown in FIG. 2*a*, the recess of the hollow profile 1 can be closed by a transparent foil 4 which surrounds the entire hollow profile 1. In this embodiment, the hollow profile can also be configured transparent or matte black, or only have a matte black coating on the outside, and have a surface which reflects a recess in the interior.

As shown in FIG. 2*b*, a transparent foil 4.1 can only cover the opening of the recess and the end side of the limbs 1.1, 1.2. Particularly preferred in this case is an additional matte black foil 4 which surrounds the hollow profile 1 and, in the region of the lighting means 2, has openings, in particular in the form of holes or longitudinal holes.

Figure 3:
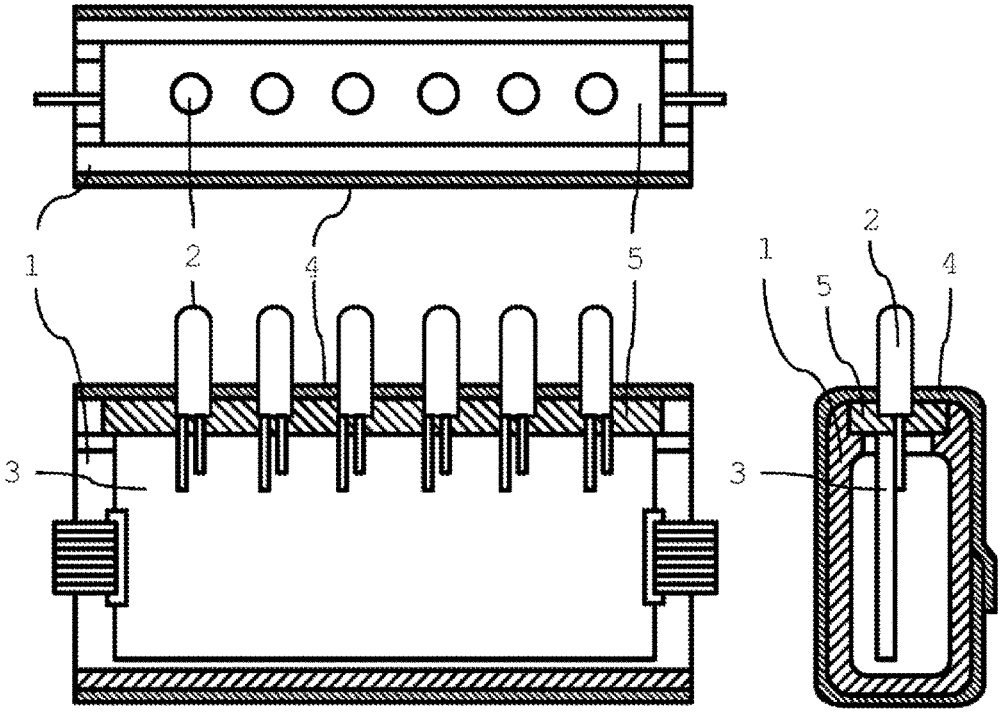
FIG. 3 shows a particularly preferred illumination or display element with support strip from the front and in the longitudinal and cross-section.

FIG. 3 shows an exemplary illumination or display device according to the invention in three sectional views. It has a series of illumination means 2, in particular ultra-bright LEDs, which are connected via a support strip 5 and are fastened to the end side of the circuit board 3. The circuit board 3 has a flat-band cable at both ends, with which the circuit board 3 is connected to the following circuit board 3 or to a control unit. The circuit board 3 contains drive stages which convert the digital signals of the control unit into voltage values for driving the individual lighting means 2. The two limbs 1.1, 1.2 each have a projection spaced apart from their face surface, by which the two projections form a support or a stop for the support strip 5. The support strip 5 forms a flush surface with the end sides of the limbs 1.1, 1.2. The support strip 5 is fixed in the position between the two limbs 1.1, 1.2 by attaching the foil 4. For this purpose, the foil 4 is adhesively configured, for example, at least in the region in which it overlaps itself and in the region with which it is in contact with the support strip 5.

The hollow profile 1 and the support strip 5 preferably consist of PEEK (polyether ether ketone). The dimensioning can be chosen differently depending on the application, for example a preferred dimensioning is disclosed. The hollow profile 1 and the support strip 5 have a wall thickness of approximately 1 mm. The width of the hollow profile 1 is 7 mm, the height is about 20 mm, the length 4 m. The foil 4 is a 0.12 mm thick laminate which is coated on one side with adhesive and completely surrounds the hollow profile 1. The lighting means 2 are high-power LEDs, which are fastened to a plurality of circuit boards 3, which are connected to each other by flat-ribbon cables. The hollow profile 1 is closed at its two ends by closure elements made of PEEK. A display element designed according to this dimensioning weighs only 0.637 kg, i.e., approximately 160 g/m, and is thereby so stable that it even withstands the down wash of a helicopter's rotor or a wind speed of 100 km/h and more.

Figure 4:
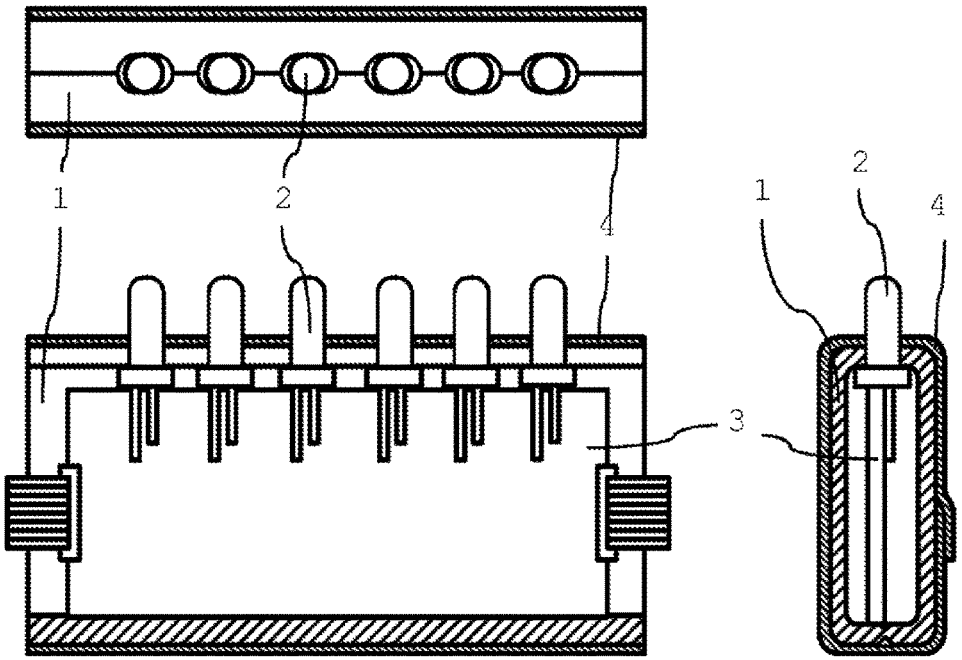
FIG. 4 shows a particularly preferred illumination or display element without support strip from the front and in the longitudinal and cross-section.

FIG. 4 shows an exemplary illumination or display device according to the invention which has no support strip 5. The limbs 1.1, 1.2 have a bar on their end side, wherein the two bars are adjacent to one another. The bars have corresponding openings in the form of holes, in particular long holes. The two limbs 1.1, 1.2 and thus the two bars can be moved apart by the application of force until the light means 2 and the electrical supply leads can be inserted into the hollow profile 1 between the bars. The lighting means 2 are fixed in the openings of the bars by withdrawing the force and mounting the foil 4, preferably with the exception of small movements in the longitudinal direction of the hollow profile 1. The openings in the bars can also be configured longer, so that a plurality of light means 2 per opening project from the hollow profile 1. In the transverse direction, the openings have the same or a slightly larger diameter than the lighting means 2, so that movements of the lighting means 2 in the transverse direction of the profile are prevented. The housing of the lighting means 2 has, in the region behind the openings, a section with a larger diameter so that the lighting means 2 can not be pulled out of the openings. The lighting means 2 are fastened to the end side of a common circuit board 3, wherein the circuit board 3 lies with its opposite surface against the base body of the hollow profile 1 in order to prevent the lighting means 2 from being pressed into the hollow profile. The same can be achieved if additional bars run parallel and spaced apart to the bars, which are used as a support surface for the lower end of the housing of the lighting means 2. This has the advantage that forces which act on the housing of the lighting means 2 are transmitted directly to the hollow profile 1 and not to the circuit board 3 first.

FIGS. 5*a*, 5*b* and 5*c* schematically show the assembly of a particularly preferred illumination or display element according to the invention. In FIG. 5*a*, the lighting means 2 are already soldered to the circuit board 3. As can be seen, the support strip 5 has a plurality of longitudinal holes, each of which can receive three lighting means 2. The three lighting means 2 can be present in the colors red, green, blue and thus form a color pixel. The longitudinal holes are covered by a self-adhesive foil strip, wherein the foil strip has three holes per elongated hole which, as shown in FIG. 5*b*, enclose the lighting means 2. Because the foil strip is flexible, the lighting means 2 do not have to be soldered to the circuit board 3 too precisely. The work steps to get from FIG. 5*a* to FIG. 5*b* consist in affixing the foil strip to the support strip 5 and putting on the support piece 5 in the direction of the end side of the circuit board 3 so that the lighting means 2 protrude partially through the holes of the foil strip. After that, the longitudinal holes of the support strip 5 can be filled with a potting material in order to fix this to the lighting means 2.

We then insert the unit consisting of support strip 5, lighting means 2 and circuit board 5 in the hollow profile 1 as already described above. As soon as the said unit is in the desired position, the foil 4 is guided with its holes over the lighting means 2 in order to produce the state shown in FIG. 5*c*. After that, the two surfaces of the foil 4 projecting out from the holes are adhered to the hollow profile 1 under tension by the lighting means 2. Contrary to the illustration of FIG. 5*c*, it is advantageous when the foil 4 closes the recess of the hollow profile 1 over its entire length. The open ends of the hollow profile are preferably closed sealed by a detonating element, wherein at least one of these detonating elements preferably has a standardized plug connector via which the data cable of the circuit board 3 can be connected to a control unit.

FIG. 6 shows a display surface according to the invention, which is composed of display elements according to the invention. For this purpose, many display elements according to the invention are attached distanced from one another to a frame not shown. The hollow profiles 1 used are thereby completely enclosed or glued with a black matte foil 4. The hollow profiles 1 have a height h which is preferably a multiple of their width b and the distance between the hollow profiles 1. As shown in FIG. 6, this achieves the state where, with a slight inclination of the hollow profiles 1, the display surface observed from the front can be perceived as a continuous surface without gaps between the individual display elements according to the invention. Background light therefore does not reach the observer directly through the display surface, and reflection of the background light between the adjacent surfaces of the display elements according to the invention is prevented by the matte black foil. Since the display surface according to the invention is still air-permeable or wind-permeable, this is, among other things, very suitable as a free-standing display surface which does not have to be mounted on a house wall or a comparable background.

A display device according to the invention is particularly advantageous based on the low weight and the increased safety in mobile or semi-mobile applications. These include video walls during concerts, changeable information signs or advertising surfaces on road vehicles, aircraft and watercraft.

The display surface according to the invention can be used particularly advantageously on a helicopter, since the display elements according to the invention make such an application useful for the first time in a secure lightweight design. As already mentioned, the configuration of the hollow profile with a height h greater than width b prevents background light, such as, in particular, the bright illumination of the sky on a sunny day, from degrading the display quality or over-radiating the image to be displayed. For this purpose, the individual display elements according to the invention are mounted radially on a bent frame as shown in FIG. 7. Due to the air-permeable configuration, the down wash generated by the rotor passes through the display surface so that the helicopter is able to fly under the rotor despite the attachment of the display surface. The radial arrangement of the individual hollow profiles 1 ensures that the display surface does not act as a supporting surface and thus does not provide additional, undesirable lift during the forward flight. Particularly advantageously, the individual hollow profiles 1 are each completely enclosed by the foil 4, so that the fragments of the hollow profiles 1 are held together by the foil 4, even in the case of serious damage to the display surface, as might occur in the event of a collision with a bird.

FIGS. 8*a* and 8*b* show further exemplary illumination or display elements according to the invention. In these, the lighting means 2 do not point in the direction of the opening of the recess of the hollow profile 1, but rather in the direction of the base body 1.3 of the hollow profile 1. The opening of the recess is in turn closed by a foil 4.

As shown in FIG. 8*a*, the limbs 1.1, 1.2 of the hollow profile 1 can again have projections for receiving a wider housing part of the lighting means 2. The groove formed by the two projections can also be used to receive a support strip 5. Since the lighting means 2 are oriented in the direction of the base body 1.3, this or the entire hollow profile 1 is configured transparent or translucent. The recess of the hollow profile 1 as well as a part of the outer lateral surfaces of the limbs 1.1, 1.2 can be covered, as shown, by an opaque, preferably matte black foil 4, or alternatively, depending on the requirement for the transparency of the illumination or display element, the film 4 can also be configured transparent.

As shown in FIG. 8*b*, holes, in particular long holes, can also be present in the base body 1.3 of the hollow profile 1 for the passage of the lighting means 2. The foil 4 encloses the entire hollow profile 1 and, on the one hand, includes the lighting means 2, and on the other hand, the recess of the hollow profile 1. A particularly simple construction results when the housings of the lighting means 2 have a wider area and this wider area rests internally on the base body 1.3 and the lighting means 2 are fixed in this position in which the foil 4 is clamped over the rear end of the circuit board 3. An elastic foil 4 can thereby absorb shocks which act on the lighting means 2.

The following generalizations refer by way of example what may be used in the context of the invention:

In the figures, the illumination or display elements according to the invention are illustrated with the preferred rounded-rectangular to longitudinal-oval outer circumference. According to the invention, the illumination or display elements according to the invention or the hollow profiles 1 open on one side also have a different, symmetrical or asymmetrical cross-sectional shape, for example circular, round, oval or polygonal.

In the preferred embodiment, the illumination or display elements according to the invention are configured straight-line in the longitudinal direction, according to the invention, these can also be arbitrarily bent or arched in the longitudinal direction.

The invention claimed is:

1. An illumination or display element, comprising a hollow profile having a recess, which extends in a longitudinal direction, for receiving a plurality of lighting means, wherein the hollow profile comprises two parallel, spaced apart limbs connected by a base body, the recess being located between the limbs, wherein the recess of the hollow profile is closed by a foil extending at least over a part of an outer lateral surface of the limbs, wherein the foil completely surrounds the hollow profile, wherein the limbs each have a bar remote from the base body that are adjacent to each other and can be moved from one another by applying a force.

2. The illumination or display element according to claim 1, wherein the lighting means extend through holes in the foil and partially protrude from the hollow profile.

3. The illumination or display element according to claim 1, wherein the foil is flexible.

4. The illumination or display element according to claim 1, wherein the lighting means are facing the opening of the recess of the hollow profile does not protrude from the hollow profile, and the foil is at least transparent or translucent in the region in front of the lighting means.

5. The illumination or display element according to claim 1, wherein the lighting means project through holes in the base body.

6. The illumination or display element according to claim 1, wherein the two bars have two corresponding recesses forming holes for the passage of the lighting means.

7. The illumination or display element according to claim 1, wherein the plurality of lighting means are connected by a support strip that extends in the longitudinal direction of the hollow profile.

8. The illumination or display element according to claim 1, wherein electrical lines for the lighting means are attached to one or more circuit boards, wherein the circuit boards have a bus system and driver stages through which the lighting means are individually controllable.

9. The illumination or display element according to claim 1, wherein a plurality of the illumination or display elements are arranged at a distance from one another and thus form a display surface.

10. The illumination or display element according to claim 8, wherein the circuit boards are connected to a control unit with flexible electrical connections to one another and at an end of the illumination or display element.

11. The illumination or display element according to claim 9, wherein the plurality of display elements of the display surface are mounted free-standing on a rack frame.

12. The illumination or display element according to claim 9, wherein the display surface is fastened to a land vehicle, watercraft, aircraft, or helicopter.

13. The illumination or display element according to claim 11, characterized in that the display surface is fastened to a land vehicle, watercraft, aircraft, or helicopter.

14. An illumination or display element, comprising a hollow profile having a recess, which extends in a longitudinal direction, for receiving a plurality of lighting means, wherein the hollow profile comprises two parallel, spaced apart limbs connected by a base body, the recess being located between the limbs, wherein the recess of the hollow profile is closed by a foil extending at least over a part of outer lateral surface of the limbs, wherein the lighting means face the base body of the hollow profile, wherein at least the base body of the hollow profile is transparent or translucent, wherein the limbs each have a bar remote from the base body that are adjacent to each other and can be moved from one another by applying a force.

15. An illumination or display element, comprising a hollow profile having a recess, which extends in a longitudinal direction, for receiving a plurality of lighting means, wherein the hollow profile comprises two parallel, spaced apart limbs connected by a base body, the recess being located between the limbs, wherein the recess of the hollow profile is closed by a foil extending at least over a part of outer lateral surface of the limbs, wherein each lighting means has its own housing having a section with a cross-section which is increased with respect to the remaining housing, wherein the limbs each have a bar remote from the base body that are adjacent to each other and can be moved from one another by applying a force.

16. An illumination or display element, comprising a hollow profile having a recess, which extends in a longitudinal direction, for receiving a plurality of lighting means, wherein the hollow profile comprises two parallel, spaced apart limbs connected by a base body, the recess being located between the limbs, wherein the recess of the hollow profile is closed by a foil extending at least over a part of outer lateral surface of the limbs, wherein a plurality of lighting means are connected by a support strip that extends in the longitudinal direction of the hollow profile, wherein at least one limb of the hollow profile has a stop for a support strip or housing of the lighting means, wherein the limbs each have a bar remote from the base body that are adjacent to each other and can be moved from one another by applying a force.

17. An illumination or display element, comprising a hollow profile having a recess, which extends in a longitudinal direction, for receiving a plurality of lighting means, wherein the hollow profile comprises two parallel, spaced apart limbs connected by a base body, the recess being located between the limbs, wherein the recess of the hollow profile is closed by a foil extending at least over a part of outer lateral surface of the limbs, wherein the limbs of the hollow profile each have a groove or two projections for receiving a support strip or a housing section of the lighting means, wherein the limbs each have a bar remote from the base body that are adjacent to each other and can be moved from one another by applying a force.

18. An illumination or display element, comprising a hollow profile having a recess that extends in a longitudinal direction for receiving a plurality of lighting means, wherein the recess of the hollow profile is closed by a foil that is matte black, wherein limbs each have a bar remote from a base body that are adjacent to each other and can be moved from one another by applying a force.

19. The illumination or display element according to claim 18, wherein the lighting means extend through holes in the foil and partially protrude from the hollow profile.

20. An illumination or display element, comprising a hollow profile having a recess that extends in a longitudinal direction for receiving a plurality of lighting means;

wherein the recess of the hollow profile is closed by a foil;

wherein the hollow profile comprises two parallel, spaced apart limbs that are connected by a base body;

wherein the limbs each have a bar remote from the base body;

wherein the bars are adjacent to each other and can be moved from one another by applying a force, and wherein the two bars have two corresponding recesses forming holes for passage of the lighting means.

* * * * *